US010677059B2

(12) United States Patent
Ghodsi-Khameneh et al.

(10) Patent No.: US 10,677,059 B2
(45) Date of Patent: Jun. 9, 2020

(54) ROTARY PUMP WITH DEFORMABLE PUMP RING

(71) Applicant: EBM-PAPST ST. GEORGEN GMBH & CO. KG, St. Georgen (DE)

(72) Inventors: Hassan Ghodsi-Khameneh, Offenburg (DE); Alexander Hahn, Eigeltingen-Heudorf (DE)

(73) Assignee: ebm—papst St. Georgen GmbH & Co. KG, St. Georgen (DE)

( * ) Notice: Subject to any disclaimer, the term of this patent is extended or adjusted under 35 U.S.C. 154(b) by 332 days.

(21) Appl. No.: 15/557,125

(22) PCT Filed: Mar. 31, 2016

(86) PCT No.: PCT/EP2016/057158
§ 371 (c)(1),
(2) Date: Sep. 10, 2017

(87) PCT Pub. No.: WO2016/173801
PCT Pub. Date: Nov. 3, 2016

(65) Prior Publication Data

US 2018/0045050 A1 Feb. 15, 2018

(30) Foreign Application Priority Data

Apr. 29, 2015 (DE) ..... 10 2015 106 613

(51) Int. Cl.
*F01C 5/02* (2006.01)
*F04C 5/00* (2006.01)
(Continued)

(52) U.S. Cl.
CPC ..... *F01C 5/02* (2013.01); *F04C 5/00* (2013.01); *F01N 3/10* (2013.01);
(Continued)

(58) Field of Classification Search
CPC .... F01C 5/02; F04C 15/0015; F04B 43/1238; F04B 43/0036; F04B 43/0054; F04B 43/12; F04B 43/14
(Continued)

(56) References Cited

U.S. PATENT DOCUMENTS 2,544,628 A * 3/1951 Copping ..... F04B 43/14 417/476
3,408,947 A * 11/1968 McMillan ..... F04B 43/14 418/45
(Continued)

FOREIGN PATENT DOCUMENTS

DE 10-2011-015110 2/2012 ..... F04D 15/00
DE 10-2013-104245 A 10/2014 ..... F04C 5/00
(Continued)

*Primary Examiner* — Deming Wan
(74) *Attorney, Agent, or Firm* — Dickinson Wright PLLC

(57) ABSTRACT

The invention relates to a pump device (10) for pumping a fluid (13), comprising: a pump housing (12) having an annular portion (22); a pump ring (14), which is deformable and defines an annular pump chamber (57) at least in some portions; a first connection (51) and a second connection (52), said first connection (51) and said second connection (52) being in fluid communication with the pump chamber (57); an eccentric (18), which is designed to be rotatable relative to the pump housing (12) and which is arranged such in the pump device (10) that the eccentric (18), depending on a current rotational position of the eccentric (18), deforms the pump ring (14) in such a way that the pump ring (14) presses at least partially against the annular portion (22) in order to pump, by way of a rotation of the eccentric (18), the fluid (13) along the pump chamber (57) from the first connection (51) to the second connection (52) depending on the current rotational position of the eccentric; and a clamping element (114), which is designed to statically press the pump ring (14) against the annular portion (22) of the pump
(Continued)

Figure 1:
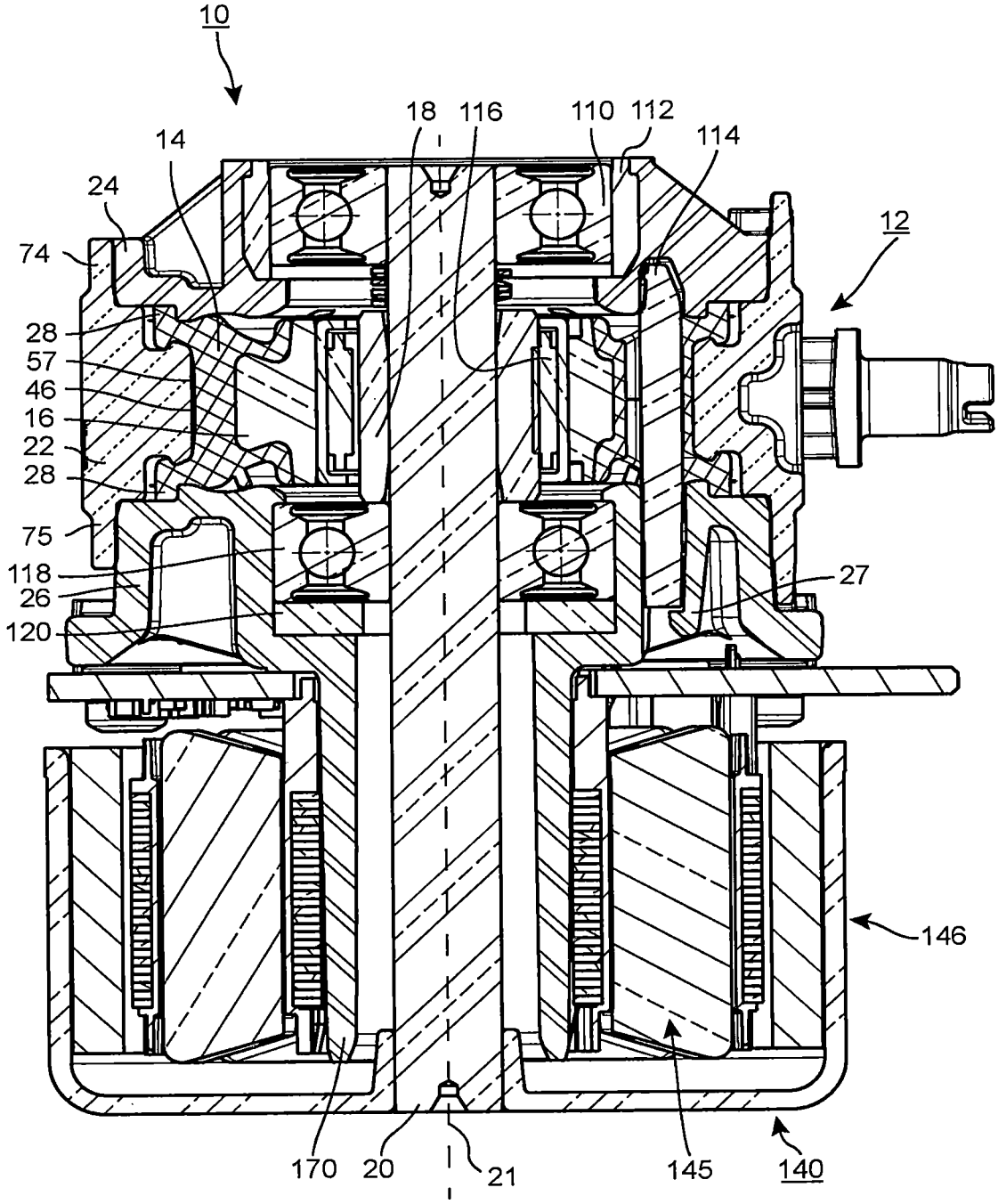

housing (12) in a clamping link region (45). The pump ring (14) has at least one recess (47) for accommodating at least part of the clamping element (114), said recess (47) being dimensioned such that in each rotational position of the eccentric (18) at least in some portions a distance (48) between the radially inner side (50) of the clamping element (114) and the pump ring (14) is provided.

19 Claims, 10 Drawing Sheets

(51) Int. Cl.

| | |
|---|---|
| ***F04C 15/00*** | (2006.01) |
| ***F04B 43/12*** | (2006.01) |
| ***F04B 43/14*** | (2006.01) |
| ***F04B 43/00*** | (2006.01) |
| *F01N 3/10* | (2006.01) |

(52) U.S. Cl.
CPC ..... *F01N 2610/1433* (2013.01); *F04C 2210/1083* (2013.01); *F04C 2240/30* (2013.01)

(58) Field of Classification Search
USPC ..... 418/153, 152, 125, 127–129
See application file for complete search history.

(56) References Cited

U.S. PATENT DOCUMENTS

| | | | | |
|---|---|---|---|---|
| 4,332,534 | A * | 6/1982 | Becker | F04B 43/14 418/153 |
| 9,453,507 | B2 * | 9/2016 | Ghodsi-Kameneh | F01C 21/08 |
| 9,752,484 | B2 | 9/2017 | Brueck | F01N 3/28 |
| 2014/0017094 | A1 | 1/2014 | Ghodsi-Kameneh | 417/44.1 |
| 2017/0144692 | A1 | 4/2017 | Hodgson et al. | F01N 3/20 |

FOREIGN PATENT DOCUMENTS

| | | | | |
|---|---|---|---|---|
| GB | 583578 | A | 11/1944 | |
| WO | WO 2012-126544 | A | 9/2012 | F04B 13/00 |
| WO | WO 2015-140207 | A | 9/2015 | F01N 3/20 |

* cited by examiner

ROTARY PUMP WITH DEFORMABLE PUMP RING

A pump device or pump is understood here to mean a machine which serves to transport fluids. These also include fluid-solid mixtures, pastes and fluids with a slight gas content. During operation of the pump device, the work of the drive is converted into the kinetic energy of the transported fluid.

The illustrated pump device is also referred to as an orbital pump, rotary diaphragm pump or peristaltic pump.

The pump device can be used to transport a fluid from a reservoir, for example a tank, into a desired environment, for example into an exhaust system of an internal combustion engine.

Known from the publication DE 10 2013 104 245 A1 is a pump device which is configured as an orbital pump which has a pump housing with at least one inlet and at least one outlet, wherein an eccentric is arranged on the pump housing so as to be rotatable relative to the pump housing. An electric drive is provided in order to move the eccentric. Arranged between the eccentric and the pump housing is a deformable diaphragm which, together with the pump housing, delimits a delivery path from the at least one inlet to the at least one outlet and forms at least one seal of the delivery path. The at least one seal is displaceable, through a movement of the eccentric, in order to deliver the fluid along the delivery path.

The publication WO 2012/126544 A1 describes a metering system for metering a liquid with a pump device which is equipped with an eccentric drive which can be driven by an electric motor. The pump device, which has two delivery directions, has a pump ring and a stationary ring which is arranged relative to the pump ring and to the eccentric drive in such a way that a pump chamber is formed between the stationary ring and the pump ring which changes shape upon rotation of the electric motor, in order to deliver a liquid to be metered through the pump chamber. The functional principle of an orbital pump is described in this publication.

Against this background, it is an object of the present invention to provide a new pump.

A pump device for pumping a fluid is presented which comprises a pump housing having an annular portion, a pump ring which is deformable and defines an annular pump chamber, at least in some portions; a first connection and a second connection, said first connection and said second connection each being in fluid communication with the pump chamber; an eccentric which is configured to be rotatable relative to the pump housing and which is arranged in the pump device such that, depending on a current rotational position of the eccentric, the eccentric deforms the pump ring in such a way that the pump ring presses at least partially against the annular portion in order, by way of a rotation of the eccentric, to pump the fluid along the pump chamber from the first connection to the second connection depending on the current rotational position of the eccentric; and a clamping element, which is configured to statically press the pump ring against the annular portion of the pump housing in a clamping element region, wherein the pump ring has at least one recess for accommodating at least part of the clamping element, said recess being dimensioned such that, in each rotational position of the eccentric, a distance is provided, at least in some portions, between the radially inner side of the clamping element and the pump ring.

One advantage of the presented pump device is that the pump device has a clamping element which is introduced into a recess of the pump ring. Such a clamping element frequently has an increased stiffness in comparison with the pump ring, so that, upon compression of the pump ring, the clamping element alters the expansion and compression behavior of the pump ring in certain regions. While the eccentric rotates in the pump device and deforms or compresses the pump ring, the clamping element is arranged in the recess of the pump ring such that a distance is provided, at least in some portions, between the radially inner side of the clamping element and the pump ring, i.e. the clamping element only partially fills the recess. This design prevents the pump ring, to which force is applied by the eccentric, from pressing directly against the clamping element and being pulled away therefrom. Without this recess, the deformation of the system through the eccentric would have to be effected completely by means of a compression and expansion of the pump ring. In contrast, the recess in the clamping element region makes possible an at least partial decoupling between the clamping element and the region of the pump ring arranged on the radially inner side of the clamping element, in that the deformation partially takes place through the deformation of the recess. This leads to a reduction in the forces necessary for the rotation of the eccentric and to a reduction in the mechanical loading of the pump ring in the clamping element region, in particular a reduction in the stresses occurring within the pump ring. The reduced mechanical loading also reduces the risk of a leak in the clamping element region.

In particular, the volume of the recess in the region between the radially inner side of the clamping element and the pump ring can vary reversibly, depending on the current rotational position of the eccentric, i.e. the recess can deform dynamically in this region, depending on the rotational position of the eccentric, and so influence the compression behavior of the pump ring or its stiffness.

If one considers a first condition with a first rotational position of the eccentric, in which the eccentric points away from the clamping element region, and a second condition with a second rotational position of the eccentric in which the eccentric points towards the region of the clamping element, the pump ring is more compressed in the clamping element region in the second state than in the first state. Preferably, the volume of the recess of the pump ring changes from the first state to the second (compressed) state, wherein the volume is preferably greater in the first state than in the second (compressed) state.

Preferably, the recess has a predetermined minimum volume on the radially inner side of the clamping element in each rotational position of the eccentric, and the clamping element is preferably, at least in certain areas, not in contact with the pump ring on the radially inner side in each rotational position of the eccentric, in order to facilitate the rotation of the eccentric towards the region of the clamping element.

In one possible embodiment of the presented pump device, the pump chamber is formed between the pump chamber and the annular portion.

In particular, the pump chamber, in which fluid to be transported moves, is formed between the pump ring and the annular portion of the pump device, so that a movement of the pump ring or a localized compression of the pump ring partially closes the pump chamber and the fluid is transported from the compressed region and in consequence moves through the pump chamber.

In a further possible embodiment of the presented pump device, the clamping element is configured to press at least a part of the pump ring in the clamping element region between the first connection and the second connection statically against the annular portion and, in consequence, reduce or prevent a fluid flow between the first connection and the second connection via the clamping element region.

According to one possible embodiment, a pump ring support is connected, in particular firmly connected, with the pump ring.

Preferably, the pump ring support has at least one pump ring support recess in the circumferential region of the at least one recess, of the pump ring, in which the clamping element is arranged.

The stiffness of the pump ring or of the system as a whole in the clamping element region can be influenced by the pump ring support recess, and this makes it possible for the eccentric to be rotated more readily past the clamping element region.

The pump ring support recess can be designed such that the clamping element engages, at least in predetermined rotational positions of the eccentric, in the at least one pump ring support recess, i.e. the pump ring support recess offers space for the clamping element, in particular in a rotational position of the eccentric in which it points towards the clamping element region, so that no collision occurs between the clamping element and the pump ring support. As a result, a mechanical resistance to the movement of the eccentric imparted through the clamping element is reduced, and in a rotational position, in which it points towards the clamping element, the eccentric can rotate along the pump ring support in an energy-saving manner or without the extreme application of force.

In a further possible embodiment of the presented pump device, the at least one pump ring support recess is rounded at respective ends or corners. Investigations have shown that high stresses can occur in the pump ring in the region of the pump ring support recess, and the risk of damage to the pump ring is reduced due to the rounding in this region.

The inner corners of the pump ring support recess can also be flattened or rounded off, so that sharp edges are avoided and the risk of damage to the pump ring is also reduced.

In a further possible embodiment of the presented pump device, the clamping element is supported on the pump housing on both axial sides of the pump ring. This makes possible a well-defined support of the clamping element.

In a further possible embodiment of the presented pump device, the clamping element is, at a first axial end, chamfered on the radially outer side in order to make it possible to introduce the clamping element into the recess in a material-friendly manner.

A chamfering of the clamping element makes it possible to slide the clamping element into the recess of the pump ring in a material-friendly manner, wherein the material forming the clamping element region of the pump ring and surrounding the recess of the pump ring is continuously displaced, so that the force required in order to introduce the clamping element is not applied suddenly and damage to the material of the pump ring in the clamping element region is avoided.

In a further possible embodiment of the presented pump device, the clamping element is, at a first axial end, chamfered on the radially inner side in order to make possible a gradual alignment of the clamping element on the pump housing when pushing in the clamping element.

A movement of the clamping element on entry into the recess of the pump ring can be influenced by means of the chamfering arranged on the radially inner side of the clamping element, so that as a result of the chamfering and the pressure applied by the pump ring the clamping element can initially be introduced into the recess at a slight angle (in particular angled slightly towards the axis of rotation of the eccentric) and then straightens up during the course of the movement.

According to one embodiment, the clamping element has a conical cross section, a curved outer surface and/or a radial outer surface. This reduces the risk of damage to that region of the pump ring which is compressed by the clamping element.

According to one embodiment, the radially outer sides of the clamping element are rounded off and/or curved in the region of respective points of contact with the pump ring. Avoiding the use of sharp corners and edges prevents the risk of damage to the pump ring. The design of the clamping element can nonetheless be selected freely in other regions.

In order to fix the clamping element in the pump housing, according to an exemplary embodiment the pump housing has a snap-locking element which is configured to snap into engagement on the clamping element upon introduction of the clamping element into the pump housing and thus to secure the clamping element axially. This reduces the risk of the clamping element slipping out, and assembly is made simple through the snap-locking element.

According to an exemplary embodiment, the recess has a contour in the region radially within the clamping element which includes a bulge in both circumferential directions. As a result, the recess is widened in a circumferential direction in this region and acts in a wider range of rotational positions of the eccentric.

According to an exemplary embodiment, the contour of the recess in the region radially within the clamping element has a greater maximum dimension in a circumferential direction than the radial dimension of the radially inner side of the clamping element. This makes it possible to increase the dimension of the recess in a circumferential direction in comparison with the dimension of the clamping element on the radially inner side and so increase the effect of the recess spatially.

According to an exemplary embodiment, the contour of the recess in the region radially within the clamping element has a greater maximum dimension in a circumferential direction than the maximum dimension of the clamping element in a circumferential direction. This can lead to an even greater spatial effect of the recess.

The mechanical resistance which must brought to bear on the eccentric on its path along the pump ring into the clamping element region is defined through an interplay between a size of the clamping element and a size of the pump ring support recess as well as, if applicable, the pump ring support recess. The stiffness of the pump ring can also be taken into consideration.

It is possible to influence the mechanical resistance, which is brought to bear on the eccentric on its path along the pump ring or the pump ring support in the clamping element region, by means a geometrical design of the clamping element or the recess of the pump ring and/or the pump ring support recess. The stiffness of the pump ring can be selected to be less in the clamping element region than in the region outside of the clamping element region, in order to facilitate a positioning of the eccentric relative to the clamping element region or to facilitate the rotation of the eccentric.

In particular, the recess and/or the clamping element or the pump ring support recess can comprise a catch and snap mechanism by means of which the pump ring support recess is guided into the clamping element region in selected positions of the eccentric outside of the clamping element region.

In particular, the pump device can be in fluid communication with an exhaust gas treatment system of an internal combustion engine. In this way, the exhaust gas treatment system can regulate catalytic combustion processes on the basis of urea transported by the pump device.

Further advantages and variants of the invention are disclosed in the description and the enclosed drawings.

It should be understood that the aforementioned features and those which will be explained in the following can be used, not only in the combination stated in each case, but also in other combinations, or on their own, without departing from the scope of the present invention.

Figure 2:
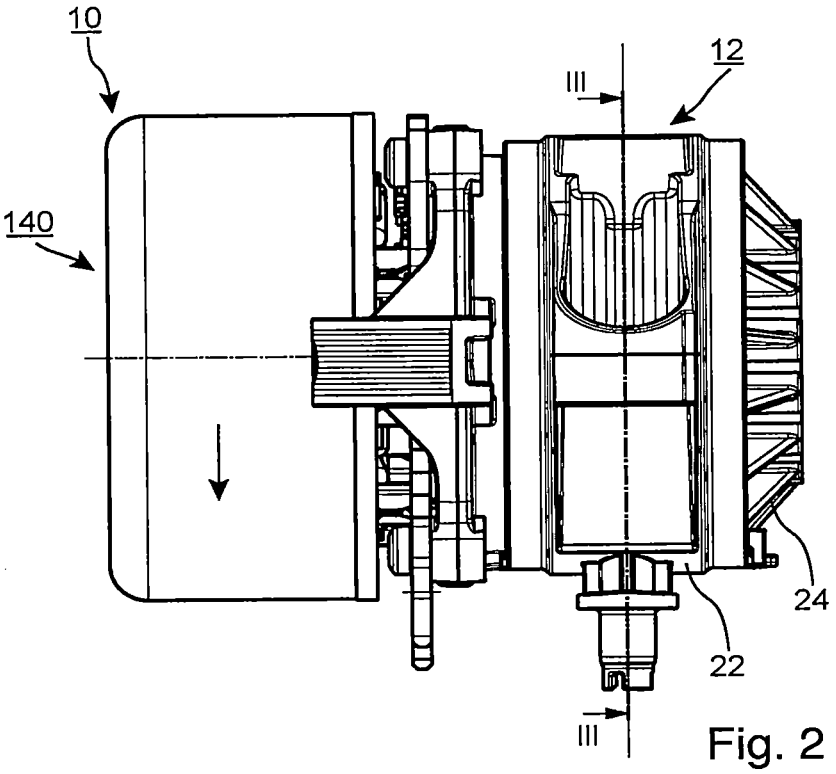
Figure 3:
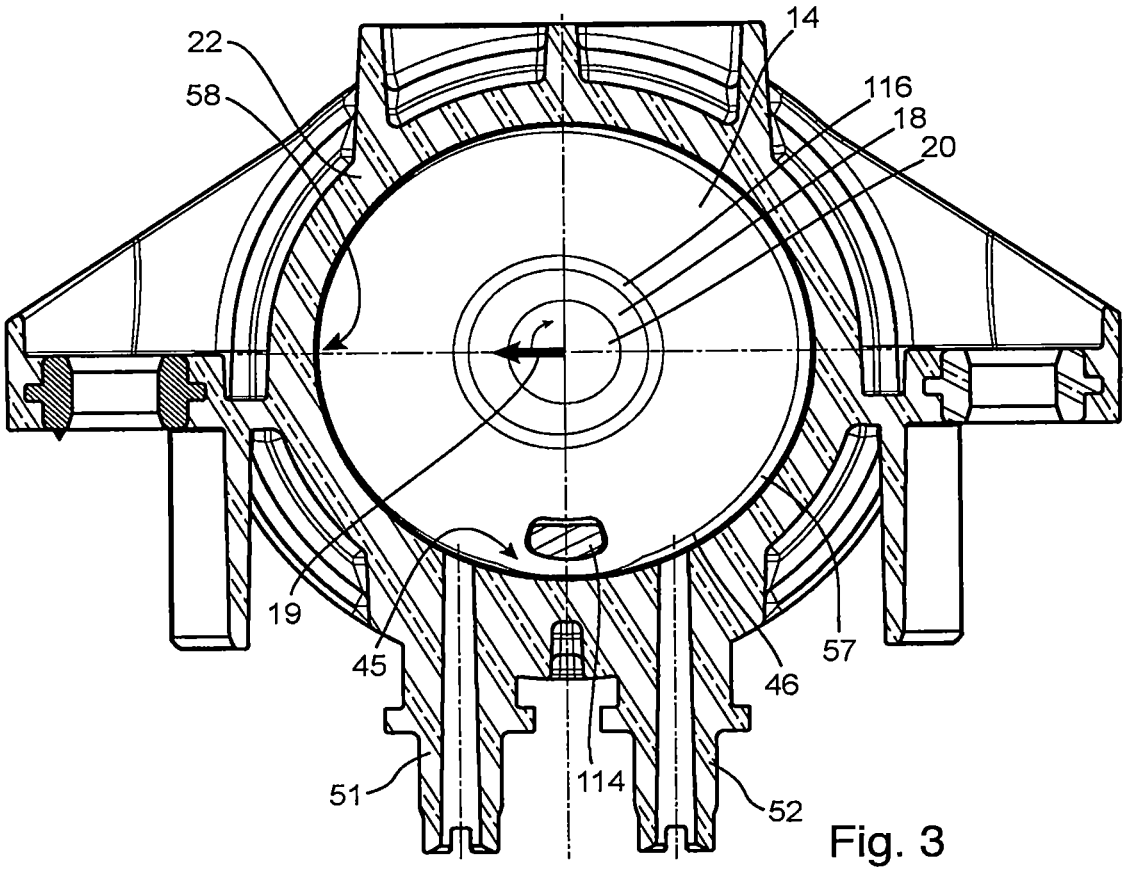
Figure 4:
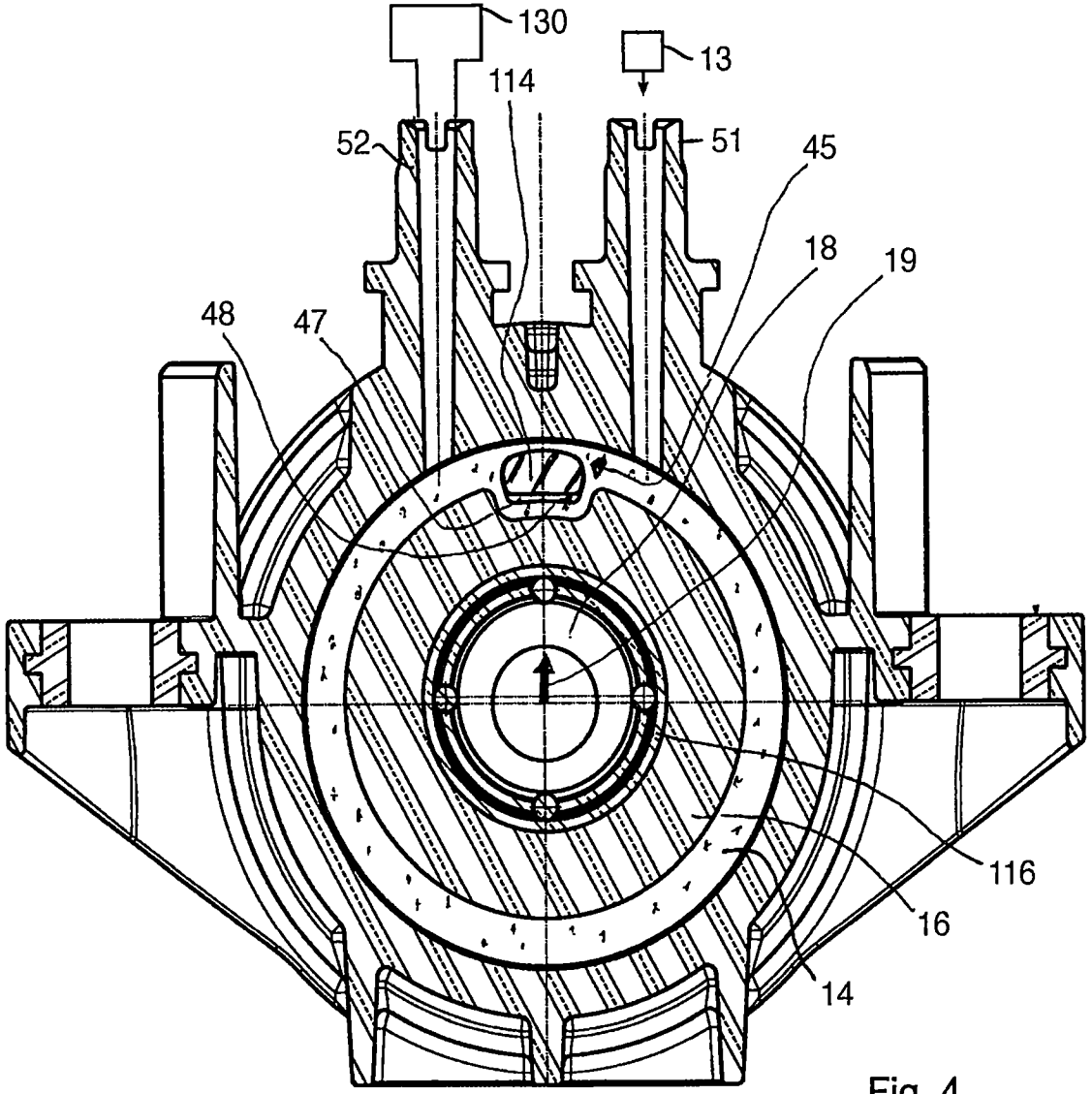
Figure 5:
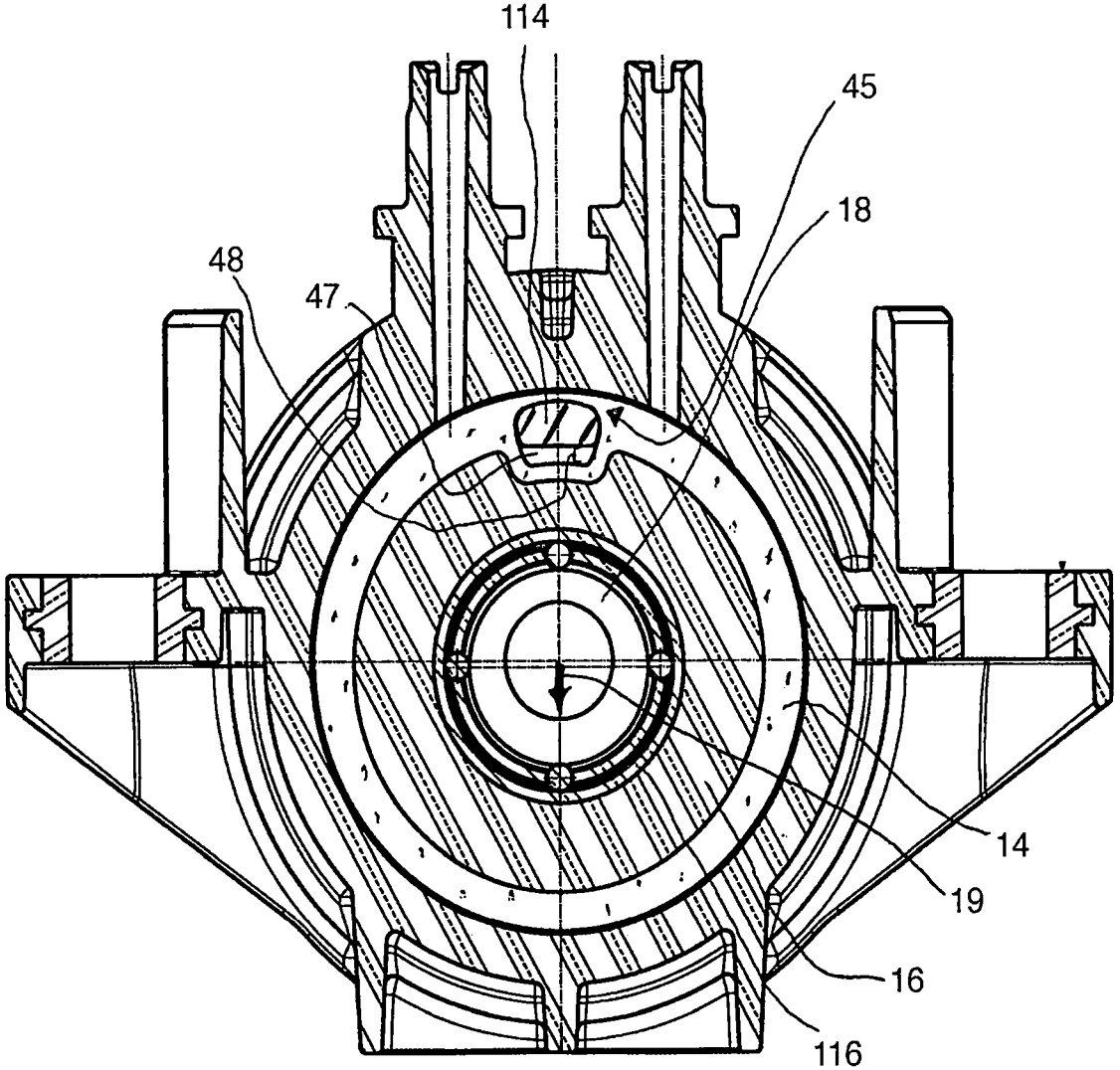
Figure 6:
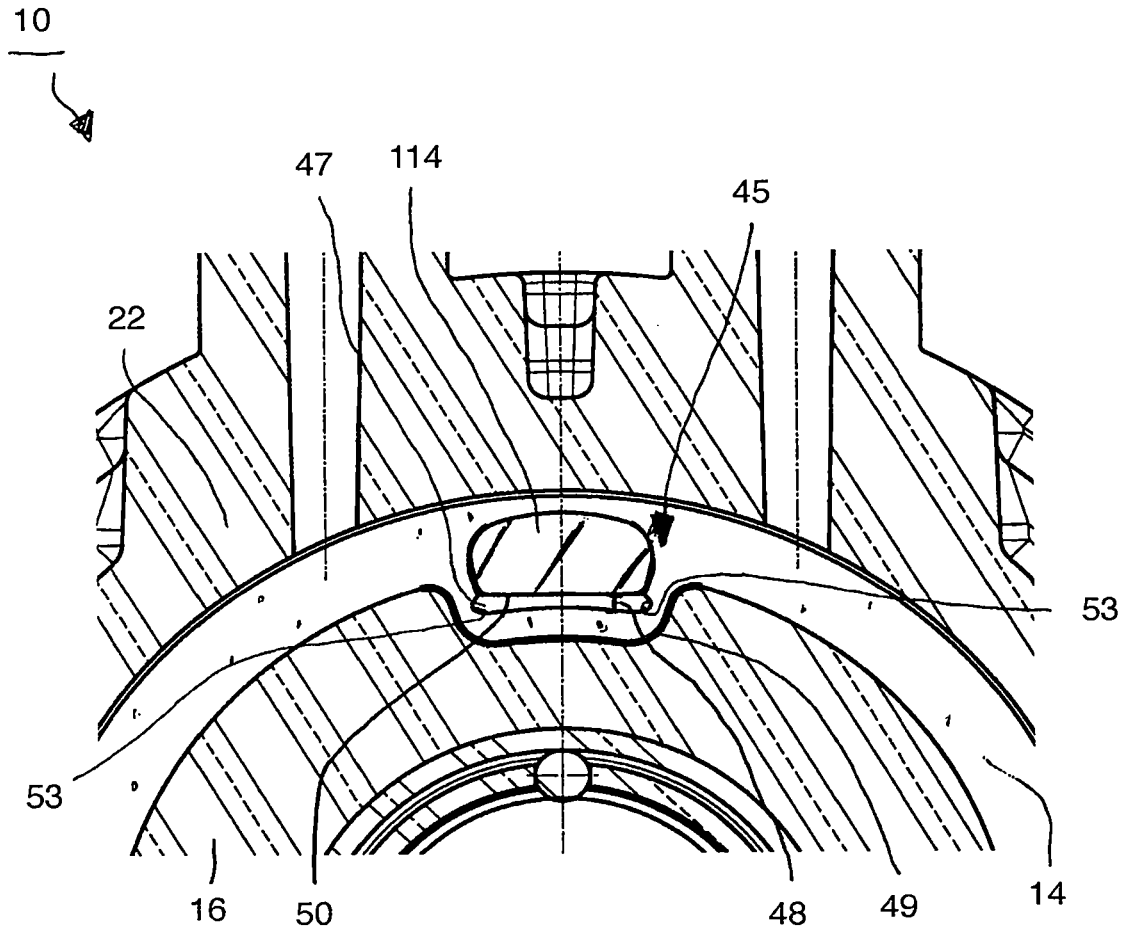
Figure 7:
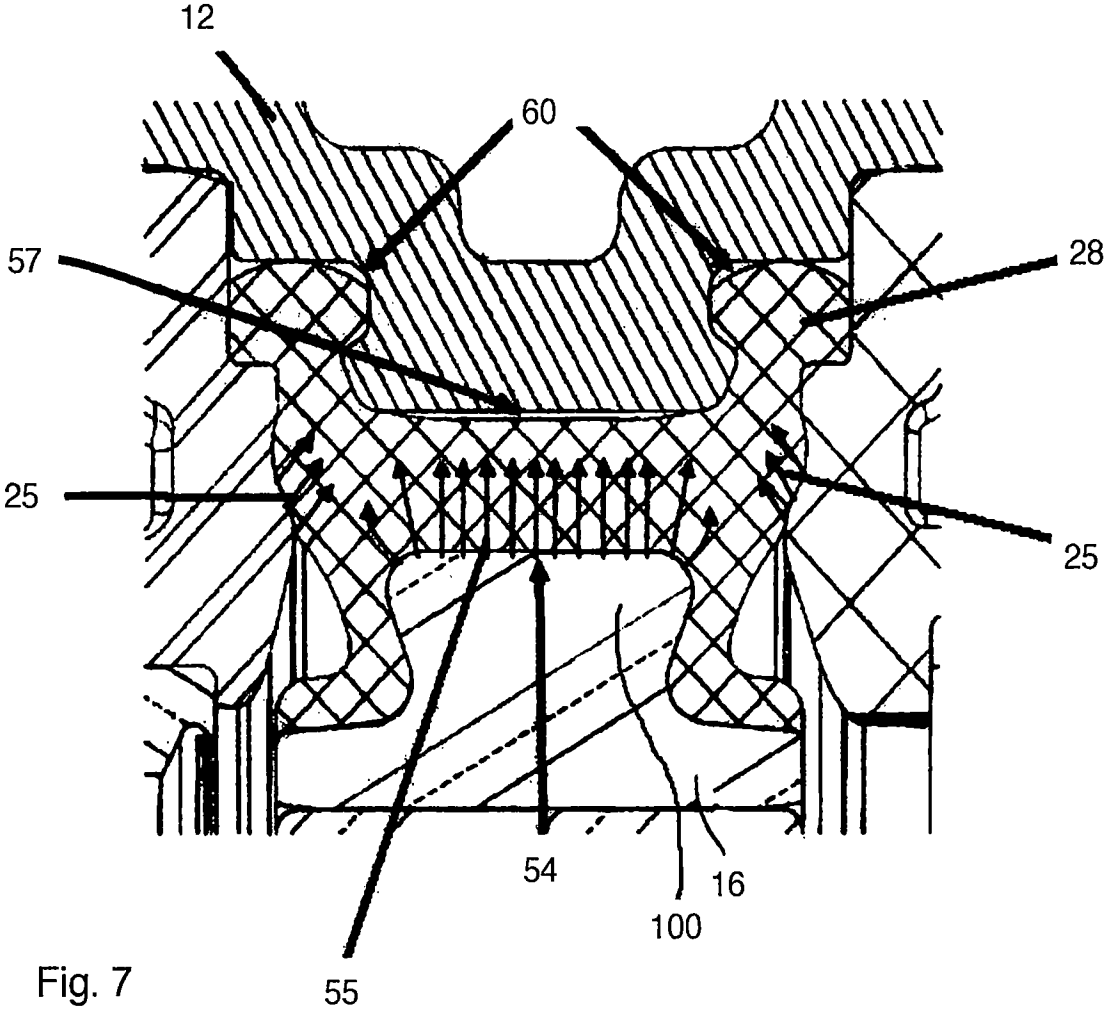
Figure 8:
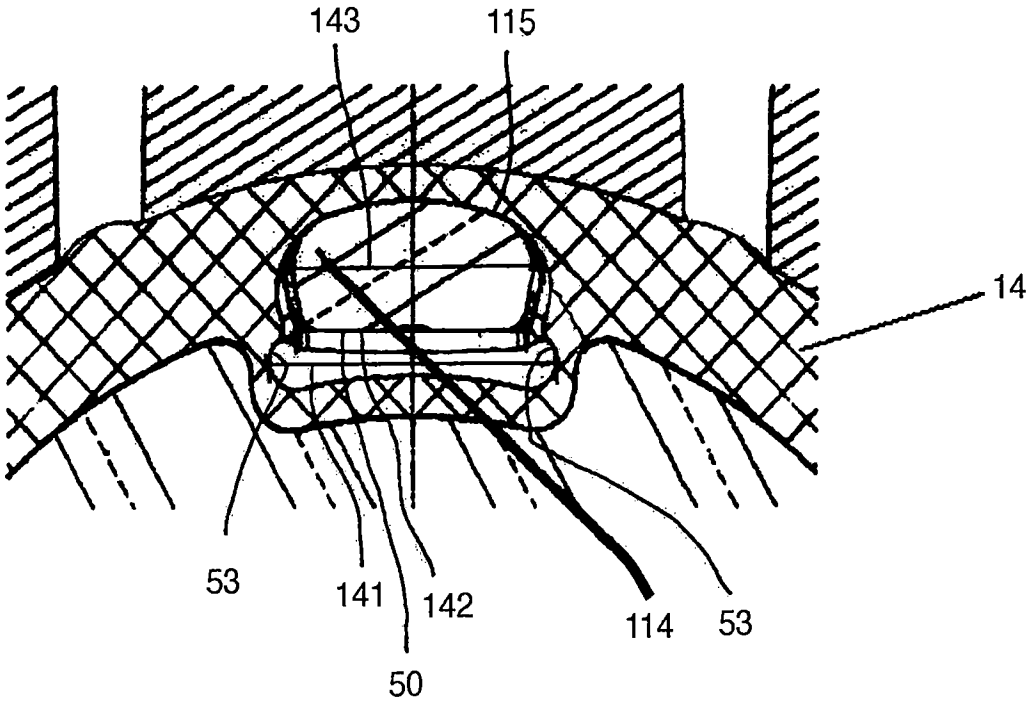
Figure 9:
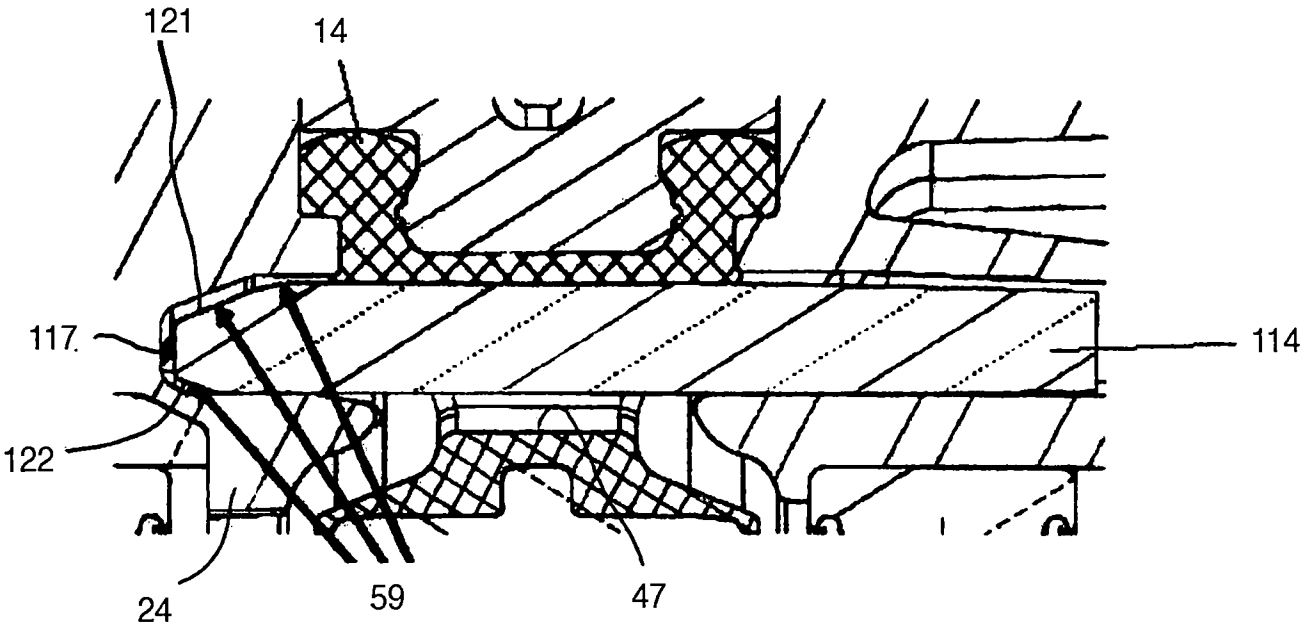
Figure 10:
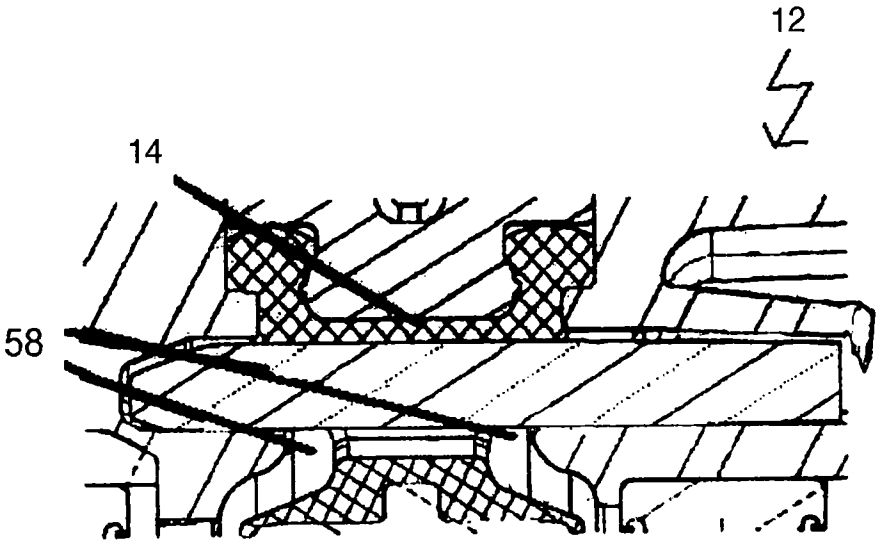
Figure 11:
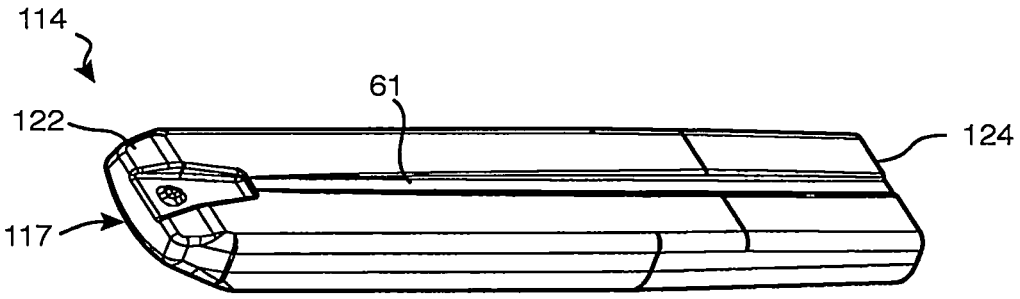
Figure 12:
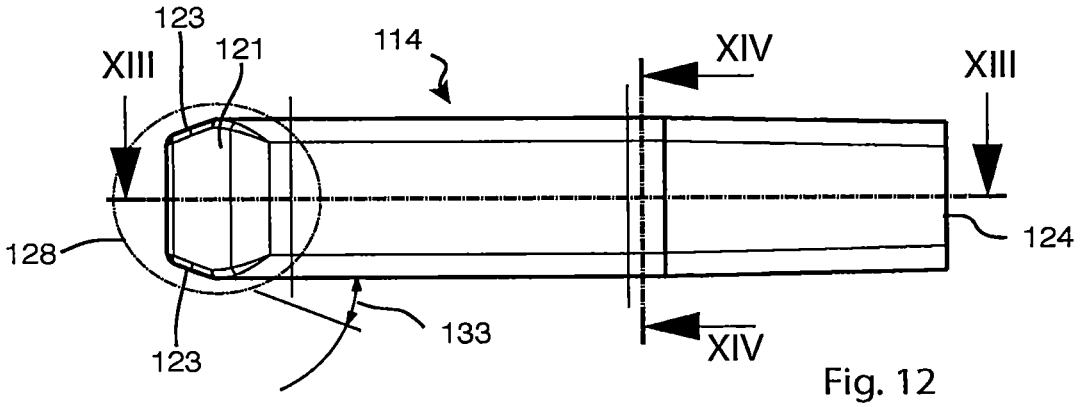
Figure 13:
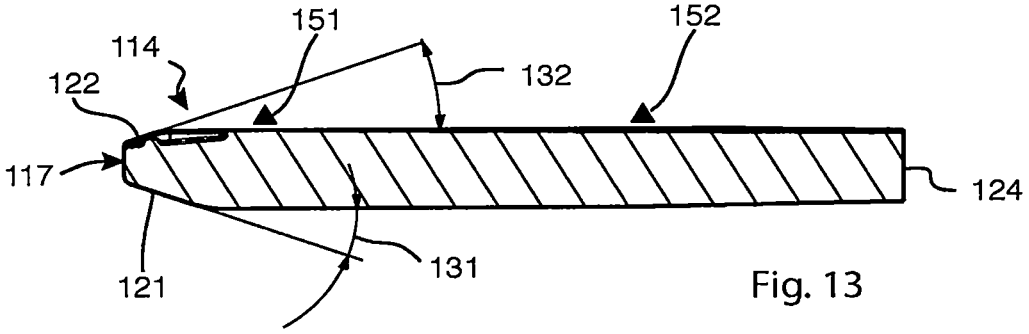
Figure 14:
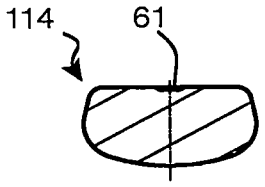

The invention is represented schematically in the drawings with reference to various embodiments and will be described schematically and in detail with reference to the drawings, wherein:

FIG. 1 shows a sectional view of an embodiment of the described pump device, FIG. 2 shows a side view of the pump device from FIG. 1, FIG. 3 shows a sectional view of the pump device from FIG. 1, FIG. 4 shows a sectional view of the pump device from FIG. 1 in a first rotational position of the eccentric, FIG. 5 shows a sectional view of the pump device from FIG. 1 in a second rotational position of the eccentric, FIG. 6 shows a pump ring of the pump device from FIG. 1 on a pump ring support, FIG. 7 shows the profile of a possible embodiment of the pump ring, FIG. 8 shows a cross section through a possible embodiment of a clamping element of the pump device from FIG. 1, FIG. 9 shows a longitudinal section through the clamping element from FIG. 8, FIG. 10 shows a longitudinal section through the clamping element from FIG. 8 with a possible embodiment of the hydraulics housing, FIG. 11 shows a three-dimensional representation of a possible embodiment of the clamping element from FIG. 1, viewed obliquely from the radially inner side, FIG. 12 shows a top view of the radially outer side of the clamping element from FIG. 11, FIG. 13 shows a section through the clamping element along the section line XIII-XIII of FIG. 12, and FIG. 14 shows a section through the clamping element along the section line XIV-XIV of FIG. 12.

FIG. 1 shows a sectional view of an embodiment of the described pump device, which is identified as a whole with the reference number 10 and is configured as an orbital pump. The illustration shows a hydraulics housing 12, a pump ring 14, a pump ring support 16, an eccentric 18, a shaft 20, a drive 140, a first bearing 110, a second bearing 118, a bushing or socket 112, which can also be described as a ring 112, a clamping element 114, which can also be described as a separating chamber pin, an eccentric bearing 116, and a sealing ring 120, which can also be described as a gasket 120.

In this embodiment, the first bearing 110 is installed as a floating bearing, and the second bearing 118 as a fixed bearing. This provides a good mounting.

A needle bearing can be used as the eccentric bearing 116. This has a short extent in a radial direction. Other bearing types, for example roller bearings, are also possible. The eccentric bearing 116 makes possible a low-friction transmission of forces between the rotating eccentric 18 and the rotationally-fixed pump ring 14 or pump ring support 16.

The hydraulics housing 12 comprises an annular portion 22 and a first lateral section 24, which can also be described as a pump cover, and a second lateral section 26, which can also be described as a motor flange or drive flange. The two lateral sections 24, 26 are arranged opposite one another. The pump ring 14 thereby lies, at least in portions thereof, between the two lateral sections 24, 26 of the hydraulics housing 12. The annular portion 22 has a first collar 74 and a second collar 75.

The drive 140 has a stator arrangement 145 and a rotor arrangement 146. The drive 140 is partially attached to a tubular region 170 of the second lateral section 26.

The pump housing 12 has a snap-locking element 27, which is designed to snap into engagement, upon introduction of the clamping element 114 into the pump housing 12 and to secure the clamping element 114 axially. The introduction of the clamping element 114 can take place before the installation of the drive 140.

The pump ring 14 is deformable and can be made of an elastomeric material or another deformable material.

FIG. 2 shows a side view of the pump device 10 shown in FIG. 1.

FIG. 3 shows a cross section through the pump device 10, viewed along the section line III-III shown in FIG. 2. A first connection 51 and a second connection 52 are provided, and these connections 51, 52 are in fluid communication with a pump chamber 57 which is formed between the annular portion 22 of the hydraulics housing and a contact surface 46 of the pump ring and in the illustration shown in FIG. 3 extends in an annular manner from the first connection 51 in a clockwise direction up to the second connection 52. In the section which extends from the first connection 51 in an anticlockwise direction up to the second connection 52, the pump chamber 57 is deactivated by the clamping element 114 in that the clamping element 114 presses the contact surface 46 of the pump ring 14 statically against the annular portion 22 of the hydraulics housing 12, thus preventing or at least greatly reducing a fluid flow through this section. The region in which the clamping element 114 presses the contact surface 46 of the pump ring 14 against the annular portion 22 is also referred to in the following as the "clamping element region" 45.

The illustration depicts the interior of the hydraulics housing 12 schematically and in an exaggerated manner, in terms of the deformation of the pump ring 14, in order to explain the principle.

The functional principle of the orbital pump is described in the following with reference to FIG. 1 and FIG. 3.

The eccentric 18 sits on the shaft 20 and is driven by this. The drive 140, typically a motor or electric motor, serves in turn to drive the shaft 20. According to one embodiment, a controllable drive 140 is provided as a drive 140.

The shaft 20 is thereby rotated about its longitudinal axis 21, which defines an axial direction of the pump device 10. The eccentric 18 is thus also moved about the longitudinal axis of the shaft 20 in a rotational movement. This movement of the eccentric 18 is transmitted via the bearing 116 and via the pump ring support 16 to the pump ring 14. The pump ring support 16 and the pump ring 14 are rotationally fixed relative to the hydraulics housing 12, but depending on the rotational position of the eccentric 18 they are moved locally closer to or further away from the annular portion 22. In FIG. 3, the eccentric 18 points in a direction indicated with an arrow 19, pointing to nine o'clock in the example illustrated, i.e. the region of the eccentric 18 with the greatest radial extent or dimension points in the direction of the arrow 19. This causes the pump ring 14 to be moved in this direction 19 and pressed against the annular portion 22 in the region 58. As a result, the pump channel 57 is narrowed or completely blocked in the region 58.

If the eccentric now rotates in a clockwise direction, the point 58 at which the pump ring 14 is pressed against the annular portion 22 also travels along in a clockwise direction, and, as a result, the fluid in the pump chamber 57 is pumped or transported in a clockwise direction from the first connection 51 to the second connection 52. A hydraulic short circuit, in which the fluid passes from the second connection 52 in a clockwise direction to the first connection 51, is prevented by the clamping element 114 or another interruption of the pump chamber 57 in this region.

The pump device 10 also functions in the reverse direction, in that the direction of rotation of the eccentric 18 is reversed.

Distance Between the Clamping Element and the Pump Ring

FIG. 4 shows a cross section through the pump housing 12 of the pump device 10 as shown in FIG. 3, wherein the eccentric 18 points in the direction of the clamping element 114, as indicated by the arrow 19. In this state, the pump ring 14 is highly compressed in the clamping element region 45, since in this region the eccentric 18 presses against the pump ring 114 via the eccentric bearing 116 and the pump ring support 16. The shown position 19 of the eccentric can, for the purpose of the description, be referred to as a "zero position" 19, wherein the position of the zero position can fundamentally be freely selected. In the chosen illustration, the eccentric 18 points in the direction 12 o'clock. The pump ring 14 has a recess 47 in which at least part of the clamping element 114 is accommodated. In the exemplary embodiment, the recess 47 is dimensioned such that, also in the shown position, a distance 48 is, at least in some portions, provided between the clamping element 114 and the pump ring 14 on the radially inner side 50 (see FIG. 6) of the clamping element 114.

This distance 48 facilitates a rotation of the eccentric 18 beyond the zero position, since as a result of the distance 48 created by the recess 47 the pump ring is more easily deformable or compressible than if no such distance 48 were provided. In other words, the mechanical resistance brought to bear on the eccentric 18 in its rotation is reduced by the recess 47.

The fluid 13 is represented schematically at the connection 51.

An exhaust gas treatment system 130 of an internal combustion engine is represented schematically in FIG. 4 in fluid communication with the connection 52, and the box 130 identifies the internal combustion engine with the exhaust gas treatment system.

FIG. 5 shows a representation analogous to FIG. 4, wherein the position of the eccentric 18 is rotated by 180° in relation to the zero position shown in FIG. 4, so that the pump ring 14 is pulled away from the clamping element 114 in the clamping element region 45. The recess 47 is in an uncompressed state and has increased its volume in comparison with the state illustrated in FIG. 4. The distance 48 between the pump ring 14 and the clamping element 114 on the radially inner side of the clamping element 114 is greater than in FIG. 4. This facilitates the rotation of the eccentric 116, also in the rotational position shown, since due to the recess 47 with the distance 48 the pump ring support 16 can be pulled away from the clamping element region 45 more readily than in the case of a pump ring 14 connected on all sides with the clamping element 114.

This embodiment of the recess 47 makes the clamping element region 45 flexible, and the pump ring 14 can readily move along with the rotation of the eccentric 18 in the clamping element region 45. Without the distance 48 between the clamping element 114 and the pump ring 14 provided on the radially inner side of the clamping element 114, the pump ring 14 would be stiffer, since the pump ring 14 might possibly be narrower in a radial direction on the inner side of the clamping element 114 than in the remainder of the pump ring 14.

Pump Ring Support Recess

FIG. 6 shows the pump ring 14 attached and fixed onto the pump ring support 16. The eccentric 18 is in the zero position, see FIG. 4. The pump ring support 16 has a pump ring support recess 49 which is emphasized by means of a thicker line. The pump ring support 16 thus has a lesser radial dimension in the clamping element region 45 than, at least partially, in regions outside of the clamping element region 45. In the exemplary embodiment shown, the outer contour of the pump ring support outside of the clamping element regions 45 is circular in the cross section shown, but can for example also be slightly oval.

The provision of the pump ring support recess 49 has the advantage, on the one hand, that a collision between the pump ring support 16 and the clamping element 114 is prevented. Alternatively, the radial dimension of the pump ring support could be reduced over the entire circumference of the pump ring support 16 and a circular form chosen. However, as a result of the greater distance of the pump ring support 16 from the annular portion 22, the performance of the pump device 10 would be less than in the exemplary embodiment shown. In contrast, the local provision of the pump ring support recess in the clamping element region 45 does not lead to a reduction in performance, since no delivery takes place via the clamping element region 45.

Bias Towards the Zero Position

The provision of the distance 48 between the radially inner side of the clamping element 114 and the pump ring 14 already encourages a rotational position of the eccentric in the zero position, i.e. pointing towards the clamping element 114, since in this region, as a result of the distance 48, the pump ring 14 can easily be displaced towards the clamping element 114. The zero position is advantageous, since in the other positions there is a greater risk that, as a result of the pressure difference between outlet and inlet, a moment is exerted on the eccentric which leads to a rotation of the eccentric 18 if this is not held by the shaft 20 (see FIG. 1).

In the exemplary embodiment shown in FIG. 6, the recess 47 projects beyond the radially inner side of the clamping element 114 in both circumferential directions, i.e. it is laterally larger than the clamping element on the radially inner side. This leads to an abrupt change in the stiffness of the pump ring 14 in these widened regions, even before the clamping element 114 has an effect on the stiffness of the pump ring in the clamping element region 45. This is manifested as a snapping effect, wherein the eccentric 18 snaps into the zero position.

In other words, in the region radially within the clamping element 114 the recess 47 has a contour which includes a bulge 53 in both circumferential directions. In the region radially within the clamping element 114, the contour of the recess 47 has in the exemplary embodiment a greater maximum dimension in a circumferential direction than the radial dimension of the radially inner side 50 of the clamping element 114.

As a result of the abrupt change in stiffness caused by the recess 47, the eccentric 18 slides particularly easily into a region radially within the clamping element 114 or into the clamping element region 45. Rotating the eccentric 18 out of the clamping element region requires a force which exceeds the normal frictional force. As a result, the eccentric 18 is held mechanically in the zero position or in the clamping element region 45.

The stiffness of the pump ring 14 can also or additionally be influenced by the configuration of the pump ring support recess such that the stiffness is less in the region of the zero position than in the regions outside of this, thus encouraging a rotational position in which the eccentric 18 points towards the clamping element region 45.

FIG. 7 shows a longitudinal section through the pump ring 14, i.e. a section along the axis 21 defined by the shaft 20 (see FIG. 1). The pump ring 14 is held in its position by the pump housing 12. For this purpose, the pump ring 14 has projections 28 and the pump housing 12 has cavities 60, wherein the projections 28 are pressed into the cavities 60 and in this way seal the pump chamber 57 laterally.

A tongue 100 formed on the pump ring support 16 projects towards the pump chamber 57, and the pump ring support 16 can displace the pump ring 14 towards the pump chamber 57 with a force 54 generated by the eccentric 18, as indicated by arrows 55.

Arrows 25 indicate how the pump housing 12 supports the pump ring 14 laterally, so that this is not deflected outwards under the action of the force 54 thus reducing the performance of the pump.

FIG. 8 shows a cross section through the pump ring 14 and the clamping element 114. The clamping element 114 has a conical cross section with a radial or generally a curved pressing surface 115, so that damage to the pump ring 14 through sharp edges is avoided when introducing the clamping element 114 into the pump ring 14.

Moreover, in the embodiment shown in FIG. 8 the bulges 53 of the recess 47 are dimensioned such that, in this region, the recess 47 has a greater maximum dimension 141 in a circumferential direction (distance between the positions of the maximum bulges 53) than the maximum dimension 143 of the clamping element 114 in a circumferential direction in this region. The maximum dimension 142 of the radially inner side 50 of the clamping element 114 is also indicated in the drawing, for the purpose of explanation.

FIG. 9 shows a longitudinal section through the pump ring 14 or the clamping element 114. It can clearly be seen that the clamping element 114 is chamfered on its axial end 117, as indicated by means of arrows 59.

The clamping element 114 has, on its first axial end 117, a chamfer 121 on the radially outer side, and this makes it possible to introduce the clamping element 114 into the recess 47 of the pump ring 14 in a material-friendly manner, since this is not abruptly pressed radially outwards when pushing in the clamping element.

The clamping element 114 has, on its first axial end 117, a chamfer 122 on the radially inner side, and this makes it possible to introduce the clamping element 114 into the recess 47 at an angle, wherein upon reaching the lateral section 24 of the pump housing 12, the clamping element 114 is at least partially continuously aligned through the chamfer 122 in that the chamfer 122 is aligned on the lateral section 24 in the manner of a ramp.

FIG. 10 shows a longitudinal section through the pump housing 12 with the pump ring 14. The pump housing 12 has, in an axial direction, recesses 58 in the parts surrounding the pump ring 14, in order to make it possible to move the pump ring 14 into these recesses 58.

FIG. 11 shows an exemplary embodiment of the clamping element 114. The clamping element 114 has a first axial end 117 and a second axial end 124 arranged opposite this, wherein the axial direction is oriented along the direction of the shaft 20, see FIG. 1.

The clamping element 114 has a groove-formed recess 61 which simplifies manufacture of the clamping element 114. The chamfer 122 on the first axial end 117 can be seen on its radially inner side.

FIG. 12 shows the radially outer side of the clamping element 114 with the chamfer 121. The clamping element has on the first axial end 117, also in the respective circumferential direction, again relative to the shaft 20 shown in FIG. 1, a chamfer 123, in the top view shown in FIG. 12 the clamping element 114 thus narrows towards the first axial end 117. This also facilitates the introduction of the clamping element 114 into the pump ring 14 during assembly.

In the exemplary embodiment, the chamfer 123 has an angle 133 of 23° relative to the main body of the clamping element 114; the angle 133 can, for example, be selected in the range from 20° to 26°.

A region 128 is drawn in on the first axial end 117 of the clamping element, and the clamping element has no corners or "sharp" edges in this region 128. This can for example be achieved in that all edges in this region 128 are rounded off, for example, with a radius of 0.5 mm or 0.7 mm.

FIG. 13 shows a sectional view of the chamfers 121 and 122 on the first axial end, which is introduced first into the pump ring 14 during assembly.

In the exemplary embodiment, the chamfer 121 has an angle 131 of 20° relative to the main body of the clamping element 114; the angle 131 can, for example, be selected in the range from 15° to 25°.

In the exemplary embodiment, the chamfer 122 has an angle 132 of 20° relative to the main body of the clamping element 114; the angle 132 can for example be selected in the range from 15° to 25°.

Two support points 151, 152 are drawn in and the clamping element 114 is supported on the pump housing 12 on these support points 151, 152, which lie on both axial sides of the pump ring 14.

FIG. 14 shows the profile of the clamping element 114.

Naturally, a wide range of variants and modifications are possible, within the scope of the present invention.

The invention claimed is:

1. Pump device (10) for pumping a fluid (13), with a pump housing (12) comprising an annular portion (22), a pump ring which is deformable and defines an annular pump chamber (57), at least in some portions, a first connection (51) and a second connection (52), said first connection (51) and said second connection (52) being in fluid communication with the pump chamber (57), an eccentric (18) which is configured to be rotatable relative to the pump housing (12) and which is arranged in the pump device (10) such that, depending on a current rotational position of the eccentric (18), the eccentric (18) deforms the pump ring (14) in such a way that the pump ring (14) presses at least partially against the annular portion (22) in order, by way of a rotation of the eccentric (18), to pump the fluid (13) along the pump chamber (57) from the first connection (51) to the second connection (52) depending on the current rotational position of the eccentric, and a clamping element (114) which is configured to statically press the pump ring (14) against the annular portion (22) of the pump housing (12) in a clamping element region (45), wherein the pump ring (14) has at least one recess (47) for accommodating at least part of the clamping element (114), said recess (47) being dimensioned such that, in each rotational position of the eccentric (18), a distance (48) is provided, at least in some portions, between the radially inner side (50) of the clamping element (114) and the pump ring (14).

2. Pump device according to claim 1, wherein a volume of the recess (47) in a region between the radially inner side (50) of the clamping element (114) and the pump ring (14) changes during each rotation as a function of a current rotational position of the eccentric.

3. Pump device according to claim 1, wherein the pump chamber (57) is formed between the pump ring (14) and the annular portion (22).

4. Pump device according to claim 1, wherein the clamping element (114) is configured to press at least a part of the pump ring (14) in the clamping element region (45) between the first connection and the second connection statically against the annular portion (22) and, in consequence, to reduce or prevent a fluid flow between the first connection and the second connection via the clamping element region (45).

5. Pump device according to claim 1, wherein a pump ring support (16) is firmly connected with the pump ring (14) and has at least one pump ring support recess (49) in a circumferential region of the at least one recess (47) of the pump ring (14).

6. Pump device according to claim 5, wherein the at least one pump ring support recess (49) is configured such that the clamping element (114) engages, at least in predetermined rotational positions of the eccentric (18), in the at least one pump ring support recess (49).

7. Pump device according to claim 5, wherein the at least one pump ring support recess (49) is rounded at respective ends of the pump ring support recess (49).

8. Pump device according to claim 1, wherein the clamping element (114) is supported on the pump housing (12) on both axial sides of the pump ring (14).

9. Pump device according to claim 1, wherein the clamping element (114) is, at a first axial end (117), chamfered on the radially outer side (121), in order to make it possible to introduce the clamping element (114) into the recess (47) in a material-friendly manner.

10. Pump device according to claim 1, wherein the clamping element (114) is, at a first axial end (117), chamfered on the radially inner side (122) in order to make possible a gradual alignment of the clamping element (114) on the pump housing (12) when pushing in the clamping element (114).

11. Pump device according to claim 1, wherein the clamping element (114) has a conical cross section, a curved outer surface and/or a radial outer surface adjacent respective points of contact with the pump ring (14).

12. Pump device according to claim 1, wherein the radially outer sides of the clamping element (114) are rounded off and/or curved adjacent respective points of contact with the pump ring (14).

13. Pump device according to claim 1, further comprising a drive (140) which is configured to rotate the eccentric (18) in such a way that the fluid (13) is transported along the pump chamber (57) from the first connection (51) to the second connection (52).

14. Pump device according to claim 1, wherein the recess (47) has a contour in the region radially within the clamping element (114) which includes a bulge (53) in both circumferential directions.

15. Pump device according to claim 1, wherein the stiffness of the pump ring (14) in the clamping element region (45) is less than in the region outside of the clamping element region (45), in order to facilitate a positioning of the eccentric (18) relative to the clamping element region (45).

16. Pump device according to claim 1, which is in fluid communication with an exhaust gas treatment system (130) of an internal combustion engine.

17. Pump device (10) for pumping a fluid (13), with a pump housing (12) comprising an annular portion (22), a pump ring which is deformable and defines an annular pump chamber (57), at least in some portions, a first connection (51) and a second connection (52), said first connection (51) and said second connection (52) being in fluid communication with the pump chamber (57), an eccentric (18) which is configured to be rotatable relative to the pump housing (12) and which is arranged in the pump device (10) such that, depending on a current rotational position of the eccentric (18), the eccentric (18) deforms the pump ring (14) in such a way that the pump ring (14) presses at least partially against the annular portion (22) in order, by way of a rotation of the eccentric (18), to pump the fluid (13) along the pump chamber (57) from the first connection (51) to the second connection (52) depending on the current rotational position of the eccentric, and a clamping element (114) which is configured to statically press the pump ring (14) against the annular portion (22) of the pump housing (12) in a clamping element region (45), wherein the pump ring (14) has at least one recess (47) for accommodating at least part of the clamping element (114), said recess (47) being dimensioned such that, in each rotational position of the eccentric (18), a distance (48) is provided, at least in some portions, between the radially inner side (50) of the clamping element (114) and the pump ring (14), wherein the recess (47) has a contour in the region radially within the clamping element (114) which includes a bulge (53) in both circumferential directions, and wherein the contour of the recess (47) in the region radially within the clamping element (114) has a greater maximum dimension (141) in a circumferential direction than the radial dimension (142) of the radially inner side (50) of the clamping element (114).

18. Pump device according to claim 16, wherein the pump housing (12) has a snap-locking element (27) which is configured to snap into engagement on introduction of the clamping element (114) into the pump housing (12) and to secure the clamping element (114) axially.

19. Pump device (10) for pumping a fluid (13), with a pump housing (12) comprising an annular portion (22), a pump ring which is deformable and defines an annular pump chamber (57), at least in some portions, a first connection (51) and a second connection (52), said first connection (51) and said second connection (52) being in fluid communication with the pump chamber (57), an eccentric (18) which is configured to be rotatable relative to the pump housing (12) and which is arranged in the pump device (10) such that, depending on a current rotational position of the eccentric (18), the eccentric (18) deforms the pump ring (14) in such a way that the pump ring (14) presses at least partially against the annular portion (22) in order, by way of a rotation of the eccentric (18), to pump the fluid (13) along the pump chamber (57) from the first connection (51) to the second connection (52) depending on the current rotational position of the eccentric, and a clamping element (114) which is configured to statically press the pump ring (14) against the annular portion (22) of the pump housing (12) in a clamping element region (45), wherein the pump ring (14) has at least one recess (47) for accommodating at least part of the clamping element (114), said recess (47) being dimensioned such that, in each rotational position of the eccentric (18), a distance (48) is provided, at least in some portions, between the radially inner side (50) of the clamping element (114) and the pump ring (14), wherein the recess (47) has a contour in the region radially within the clamping element (114) which includes a bulge (53) in both circumferential directions, and wherein the contour of the recess (47) in the region radially within the clamping element (114) has a greater maximum dimension (141) in a circumferential direction than the maximum dimension (143) of the clamping element (114) in a circumferential direction.

* * * * *